US005174779A

United States Patent [19]

Chung

[11] Patent Number: 5,174,779

[45] Date of Patent: Dec. 29, 1992

[54] ELECTRICAL CONNECTOR

[76] Inventor: Wei T. Chung, 1212 W. McKinley Ave. #9, Sunnyvale, Calif. 94086

[21] Appl. No.: 879,039

[22] Filed: May 6, 1992

[51] Int. Cl.[5] ..... H01R 13/62

[52] U.S. Cl. ..... 439/326; 439/328

[58] Field of Search ..... 439/55, 62, 65, 326-328, 439/630-637, 372

[56] References Cited

U.S. PATENT DOCUMENTS 4,986,765 1/1991 Korunsky et al. ..... 439/326

4,995,825 2/1991 Korunsky et al. ..... 439/326

*Primary Examiner*—David L. Pirlot

[57] ABSTRACT

An electrical connector (10) for receiving a circuit board (9) includes an elongated housing (1), a slot (2) lengthwise extending therein for receiving the lower portion of the board (9). A plurality of contacts (3) are side by side positioned transversely to the slot (2) for engagement with the conductive pads (91) disposed on the lower portion of the board (9). A pair of posts (17) are respectively positioned at two ends of the slot (2), each having a peg (20) at the top to be received in a corresponding hole (92) for preventing the upward withdrawal of the board (9). A pair of pivotal latches (4) are positioned ate two ends of the housing (1), which lies forward obliquely at a predetermined angle in an initial rotatable positioned for the convenience of insertion of the board (9), and further rotates with the board (9) until is fixedly secured to the housing (1) in a final fixed position. The latch (4) further includes a holding device (48) to retain the board (9) therein during rotation of the board (9). Moreover, the latch (4) comprises a retention section (51) including a retention plate (52) and a camming plate (53) for engagement with the post (17).

18 Claims, 3 Drawing Sheets

ELECTRICAL CONNECTOR

BACKGROUND OF THE INVENTION 1. Field of The Invention

The present invention relates to metal latches for a SIMM (Single In-Line Memory Module) connector, and particularly to a pivotal latch with a SIMM connector, which is capable of rotating with a board when the board is received in the connector.

2. Description of The Prior Art

Although the prior art fixed metal latch of SIMM connector as disclosed in U.S. Pat. Nos. 4,986,765, 4,995,825, 5,004,429, 5,013,257 and U.S. Pat. No. 5,094,624, has a better performance than previous plastic latch thereof, several disadvantages are as follows.

(1) During rotation of the board in the housing, two side edges of the board directly push the corresponding wedge or camming surfaces of the latches, and each action area of the board where the forces are imposed on is nearly like a line. Therefore, the stress imposed thereon is relative large so it is easy to lengthwise deform the board. This results in an improper engagement between the contacts within the connector housing and the conductive pads disposed on the lower portion of the board. Secondly, the board pushes the latch directly so the stress acting on the board is considerably large and the tiny contacts may be damaged by the transferred significant stress.

(2) There is no support or holding means for the board when it is rotated in the housing during installation. In other words, it is possible for a board to be little tilted therein due to the unbalanced rotation forces exerted by the operator. Although this tilt may be corrected when the board reaches its final fixed position, it still can harm some contacts of which if some portions protrude a little in the slot during this rotation.

(3) For the same reason as (2), the board is easily sprung out due to the contact resilient forces when the board is released from the latch during withdrawal of the board. These spring forces result in a considerable vibration to the board and the housing, even making the board drop out of the housing. This often makes the operator uncomfortable and nervous.

To overcome the aforementioned first disadvantage of the prior art connectors, one object of the present invention is to provide a latch whereby during rotation, the board does not only abut against the latch to push each other, but also have a post involved therein to transfer a portion of force thereto, so the stress acting on the board may be little reduced.

To overcome the aforementioned second and third disadvantages of the prior art connectors, another object of the invention is to provide a holding device for better retaining the board therein during rotation of the board regardless of installation or withdrawal of the board in the housing.

SUMMARY OF THE INVENTION

In accordance with the present invention, an electrical connector for receiving a circuit board includes an elongated housing, a slot lengthwise extending therein for receiving the lower portion of the board. A plurality of contacts are side by side positioned transversely to the slot for engagement with the conductive pads disposed on the lower portion of the board. A pair of posts are respectively positioned at two ends of the slot, each having a peg at the top to be received in a corresponding hole of the board for preventing the upward withdrawal of the board. A pair of pivotal latches are respectively positioned at two ends of the housing, which lies forward obliquely at a predetermined angle in an initial rotatable position for the convenience of insertion of the board, and further rotates with the board until is fixedly secured to the housing in a final fixed position.

Further, the latch includes a holding device to retain the board therein during rotation of the board regardless of installation or withdrawal of the board.

Yet, the latch has a camming plate to incorporate with a wedge disposed on the post for reducing the stress imposed on the board and facilitating rotation of the latch accompanying the board.

Still, to correspond to the latch, the housing includes a pair of cavities at two ends for receiving the latches. The cavity has protrusions therein to engage apertures in the latch for defining an axis around which the latch rotates.

Furthermore, to enhance resilience, the latch has a U-shaped base, and a lever at the top for easily applying finger pressure thereto.

DESCRIPTION OF THE PREFERRED EMBODIMENT

Figure 1:
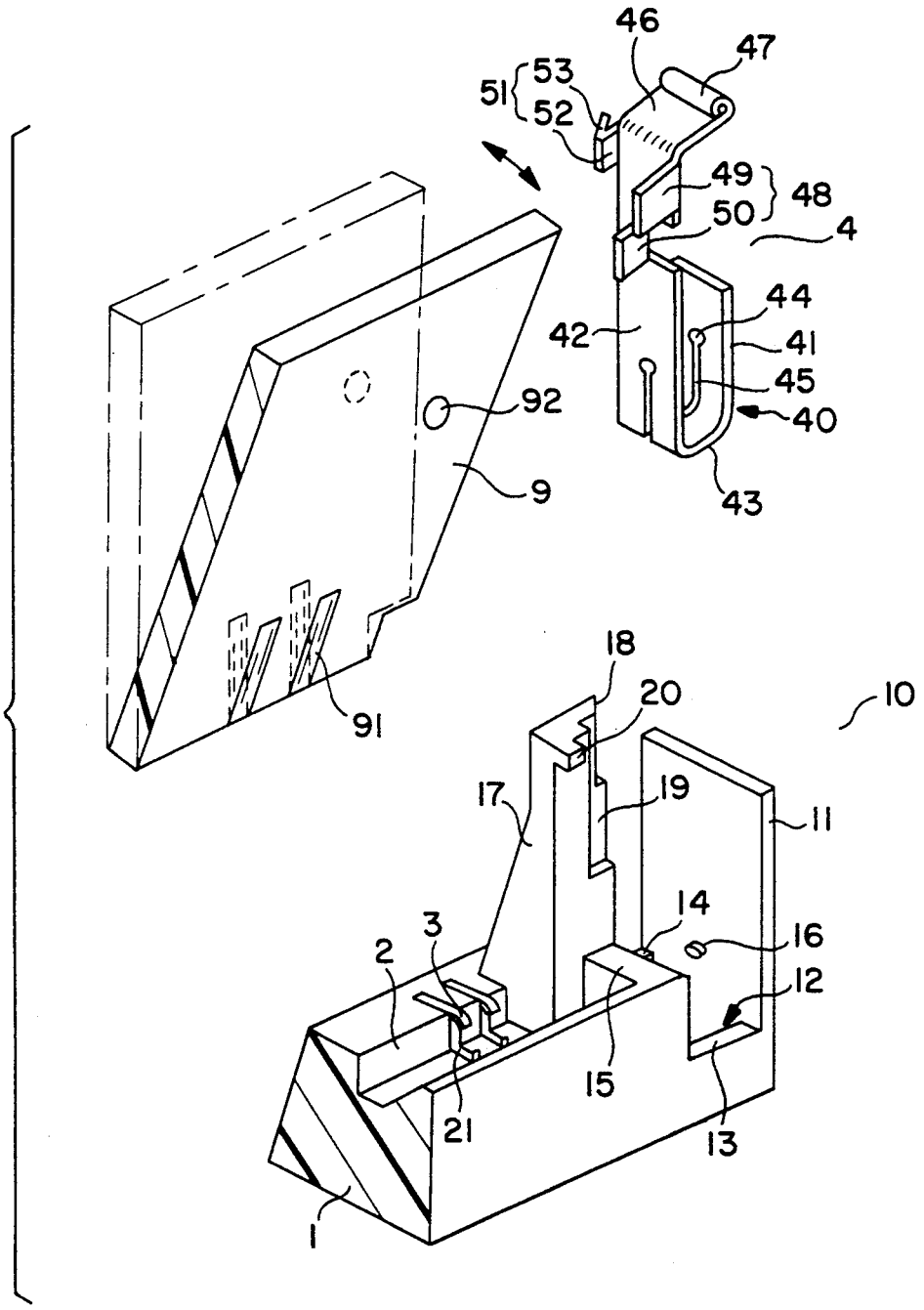
FIG. 1 is an partially exploded perspective view of one presently preferred embodiment accompanying a board according to this invention.

In the interest of brevity in this description, the central elongated portion of the connector housing is not shown in the drawings, but the structure and description thereof is incorporated hereat by reference to the aforementioned U.S. Patents. Also, for the same reason, only the right end portion of the housing is shown and described herein, and as understood it constitutes the mirror image of the left end portion of the housing because the housing is symmetric.

With reference first to FIG. 1, the subject connector 10 includes an elongated housing 1 having a lengthwise slot 2 therein to receive a corresponding circuit board 90. A plurality of grooves 21 are side by side positioned transversely to the slot 2. A plurality of corresponding contacts 3 are respectively received within the corresponding grooves 21 in order to engage a plurality of conductive pads 91 disposed on the lower portion of the board 90. The aforementioned structure is typically a basic type of a general SIMM connector.

A pair of end walls 11 are positioned at both two ends of the housing 1, respectively, and a cavity 12 is positioned adjacent each end wall 11. The cavity 12 is circumferentially formed by the end wall 11, an inner wall 15, a front wall 13 and a rear wall 14 wherein the front wall 13 and the rear wall 14 are positioned between the end wall 11 and the inner wall 15. A pair of protrusions 16 are oppositely and respectively positioned on the end wall 1 and the inner wall 15 (one on the inner wall 15 not shown) in order to be received within the corresponding apertures of the latch discussed later.

A post 17 is positioned inwardly beside each cavity 12, and a peg 20 extends laterally forward at the upper end thereof which will be received within the corresponding hole 92 of the board 90 to prevent the board 90 from upward movement. Different from the prior art connectors, in order to cooperate with operation of the latch, a wedge 18 is formed on the upper portion of the post 17 to incorporate with the corresponding camming plate of the latch discussed later. A recess 19 is positioned on the middle portion of the post 17 in order to incorporate with a holding device of the latch discussed later.

In the present embodiment, a pivotal latch 4 received within the cavity 12 of the housing 1, may be stamped and formed by one piece metal plate, which comprises a U-shaped base 40 defined by an outer leg 41, an inner leg 42, and a bight 43 intermediating therebetween. A pair of apertures 44 are respectively positioned on the outer leg 41 and the inner leg 42 to receive the pair of corresponding protrusions 16 of the housing 1. Accordingly, the latch 4 is allowed to pivot on the axis defined by the provisions 16 but can not drop out of the cavity 12. To enhance resilience of the U-shaped base 40, a slit 45 is positioned between two apertures 44 therealong, so that it is easier to press the outer leg 41 and the inner leg 42 inward to each other for easy reception of the latch 4 within the cavity 12. It is noted that the width of the slit 45 is smaller than the diameter of the aperture 44 for keeping a proper retention between the aperture 44 and the protrusion 16.

In assembling the latch 4 into the housing 1, first, the outer leg 41 and the inner leg 42 are pressed inward to each other, and then inserted into the cavity 12 in a predetermined direction. Because two legs 41 and 42 are pressed inward to reduce the space therebetween and the good resilience thereof, the outer portion of the legs 41 and 42 easily pass the protrusions 16 until the protrusions 16 are received in the corresponding apertures 44 respectively. Sequentially, the forces imposed on the outer leg 41 and the inner leg 42 are removed, and then due to the resilience, the outer leg 41 and the inner leg 42 of the U-shaped base 40 can abut against the end wall 11 and the inner wall 15, respectively. Consequently, the U-shaped base 40 is snugly positioned within the cavity 12, and due to the engagement of the protrusions 16 and the apertures 44, the latch 4 is not allowed to leave from the cavity 12.

Slantingly extending from the top of the latch 4 is a lever 46 on which the fingers impose a force so that the upper portion of the latch 4 is laterally outward moved. A folded thick portion 47 is positioned at the top end of the lever 46 so that the fingers will not easily slip therefrom in operation.

On a side edge of the latch 4 and between the U-shaped base 40 and the lever 46, a holding device 48 comprises a front plate 49 and a rear plate 50, and a space formed therebetween which is equal to the thickness of the board 9 so that the holding device 48 can provide a guidance function during insertion of the board 9, and a retention function when the board 9 is inserted into the slot 2 and sandwiched between the holding device 48 and rotated along the slot 2 from the initial rotatable position to the final fixed position.

Opposite to the holding device 48, positioned on the other side edge of the latch 4 is a retention section 51 which comprises a retention plate 52 inward extending parallel to the holding device 48 to abut against the back surface of the post 17 to secure the latch thereto when the latch accompanying the board 9 is in the final position. A camming plate 53 backward extends from the retention plate 52 to engage the wedge 18 of the post 17 for reducing the reaction force during rotation of the latch 4 accompanying the board 9.

Figure 2:
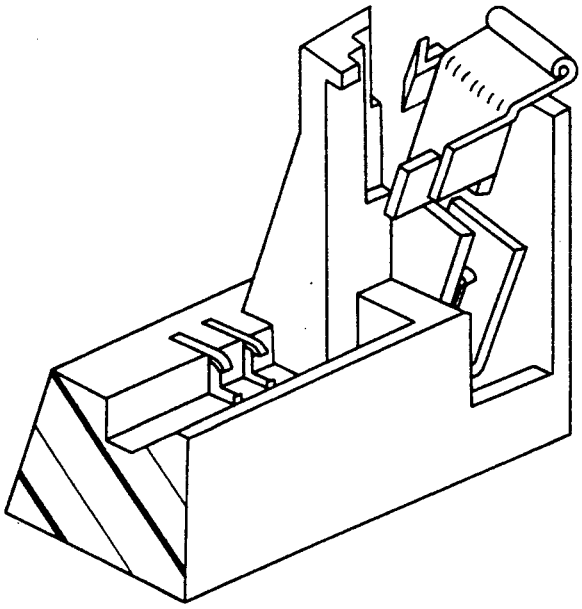
FIG. 2 is a perspective view of the assembled connector of FIG. 1 where the latch is in an initial rotatable position.

When the board 9 is not received within the housing 1, the latch 4 lies forward obliquely at a predetermined angle for the convenience of insertion of the board 9, as shown in FIG. 2. Along this direction, the board 9 is moved from the top, sandwiched between the front plate 49 and the rear plate 50, to the bottom until the lower portion enters the slot 2 of the housing 1 and the conductive pads 91 confront the lateral corresponding contacts 3 positioned within the grooves 21 (please see FIG. 3). The oblique insertion of the board 9 is a common way as used in the prior art connectors to accommodate the shape of the contact for zero insertion force. In the present embodiment, the front surface and the back surface of the board 9 abut against the front plate 49 and the rear plate 50 of the holding device 48, respectively, in a stable situation.

Successively, a force is imposed on the upper edge of the board 9, thus exerting a force imposed on the rear plate 50 of the holding device 48, so the board 9 associated with the latch 4 will rotate backwardly. Under this situation, the latch 4 is rearward rotated around the protrusions 16 and that is different from the fixed type latch used in the prior art connectors. Relatively, because the board 9 can be little slidably moved, i.e. not bound, with respect to and along the holding device 48, it is generally rotated around the slot 2 and that is similar to the prior art connectors.

During the rotation, the front surface and the back surface of the lower portion of the board 9 will touch the contacts 3 within the slot 2 and endure a gradually increasing force resulting from the resilient force due to the deformation of the contacts. The resilient force is maximum when the board 9 is in the final fixed position and that is similar to the prior art connectors.

In the present embodiment, due to the rotation of the latch 4 itself, the camming plate 53 of the retention section 5 will confront the wedge 18 of the post 17. Then the camming plate 53 of the retention section 51 and the wedge 18 of the post 17 force and push each other to pass and move. Because the latch 4 is more resilient than the post 17, the upper portion of the latch 4 will obviously move and deflect laterally due to resilience of the U-shaped base by deeming the U-shaped base 40 as a support point. The post 17 integrated with the housing 1 is stiffer so phenomena of deflection and movement is not visually obvious (please see FIGS. 4(A) and 4(B)).

Figure 5:
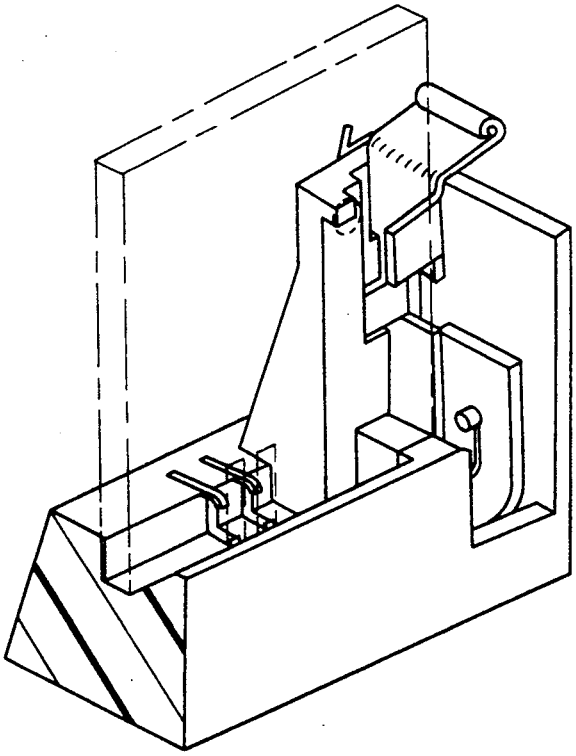
FIG. 5 is a perspective view of the assembled connector of FIG. 1 equipped with the board in a final fixed position.

After the camming plate 53 completely pass through the wedge 18 of the post 17 and the confrontation forces thereof disappear, the upper portion of the latch 4 will spring back against the post 17 due to the resilience of the U-shaped base 40. At the same time, the rear plate 50 of the latch 4 is positioned in the recess 19 of the post 17 to prevent the latch 4 from further rearward rotation. The retention plate 52 of the retention section 51 snugly abut against the back surface of post 17 to prevent the latch 4 from retrograde and forward rotation. Accordingly, the latch 4 is fixedly secured in place without any back or forth rotations. The board 9 also abuts against the posts 17 to prevent any further rearward rotation, and the pegs 20 of the posts 17 are received within the holes 92 of the board 9 to prevent the board 9 from upward movement. The combination of board 9 and the pegs 20 is similar to that of the prior art connectors (please see FIG. 5).

Figure 4B:
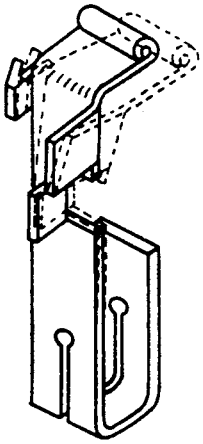
FIG. 4(B) is a perspective view of the latch to compare the configurations of the latch in a pressed situation and in a released situation.
Figure 4A:
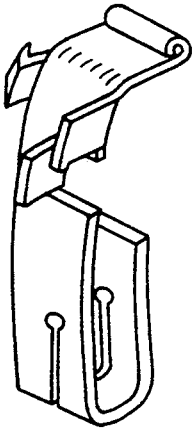
FIG. 4(A) is a perspective view of the latch to illustrate the deformation thereof when finger pressure is applied to the lever of the latch.

In contrast, to release the board 9 from the housing 1, by applying lateral finger pressure on the lever 36 of the latch 4, the upper portion of the latch 4 will laterally move and deflect outward by deeming the base 41 as a support point (also see FIG. 4(A)). The retention plate 52 moves along the back surface of the post 17. Once the retention plate 52 completely leaves the post 17, the board 9 will rotate forward on account that the lower portion of the board 9 is forced by the resilience of the contact 3. Accordingly, the board 9 will exert a force on the front plate 49 so that latch 4, accompanied by the board 9, will forward rotate around the protrusions 16 of the housing 1.

It can be understood that after the retention plate 52 is released from the post 17, by removing finger pressure from the lever 46, the camming plate 53 of the latch 4 will inward moved toward the post 17 due to the resilience of the U-shaped base 41 (also see FIG. 4(B)). In other words, the camming plate 53 of the latch 4 confronts the wedge 18 of the housing 1 again and intend to pass through the wedge 18 due to the inward resilient force exerted by the U-shaped base 41. Thus, the above action will facilitate the forward rotation of the latch 4, and this also facilitates the forward rotation of the board 9 because the rear plate 50 will push the board 9 forward when the latch rotates forward.

Figure 3:
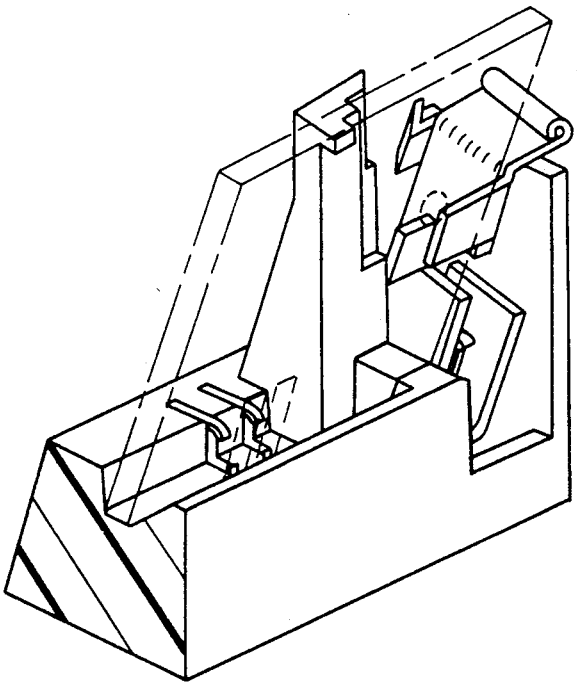
FIG. 3 is a perspective view of the assembled connector of FIG. 2 equipped with the board.

When the board 9 is back to the initial position, as shown in FIG. 3, it can be withdrawn upwards along the space defined between the front plate 49 and the rear plate 50 to leave from the housing 1. This action completes withdrawal of the board 9 as shown in FIG. 2.

It is noted that in the present invention the post 17 of the housing is not only for board retention but also for easy rotation of the board 9 associated with the latch 4. The force results from rotation of the board 9 will be dispersed to the flexible metal latch 4 and the plastic post 17. In other words, the post will absorb a portion force resulting from the rotation of the board 9. To the inserted and rotated board 9, the reaction force imposed thereon will be less than that of the prior art connectors.

In the present invention, the wedge 18 of the post 17 incorporating with the camming plate 53 also provides a reduced component force during board rotation. This function facilitates board rotation and reduces the reaction force imposed on the board 9. It is impossible for the board used in the prior art connectors to apply a wedge thereto because the board has no sufficient thickness to form a proper wedge surface to cooperate with the camming surface of the latch.

It is appreciated that during rotation the board 9 is held by the holding device 48 of the latch 4, so there is less possibility for the board 9 to tilt or move with respect to the slot 2. Thus, the board is not easily tilted by the improper exerted force to suddenly jeopardize some little protruding contacts.

It can be seen that the board 9 is held by the holding device 53 such that unlike the prior art connectors, the board 9 accompanying the latch 4 rotates forward for release. It is different from the prior art connectors where the board suddenly springs outward (forward) due to the resilience of contacts when the operator presses the levers of the latches to release the board. The holding device 53 provides better stability of operation.

Similarly, when the board is released, the operator can still retain the lever 46 of the latch 4 to control the latch's movement. So, the board 9 associated with the latch 4 can be rotated smoothly and slowly to let the operator feel comfortable. It is different from the prior art connectors where once the board is pivotally released from the fixed position, the latch no longer controls the board.

It can be noted that the holding device should be of sufficient length in order to engage the board any time in rotation of the board where the latch 4 has a little lateral deflection. It is also understood that the U-shaped base 41 provide outward resilient forces to exert proper friction forces to keep the latch 4 in place any time in the cavity 12. In some instances, a stopper may be positioned on the path of the latch 4 to restrict the forward movement of the latch 4 in order to define the initial position of the latch 4. Also, the front wall 13 and the rear wall 14 may not extend a height that prohibits the rotation of the latch if necessary.

While the invention has been described in connection with what is presently considered to be the most practical and preferred embodiments, it is to be understood that the invention is not limited to the disclosed embodiment but, on the contrary, is intended to cover various modifications and equivalent arrangements included within the spirit and the scope of the appended claims.

What is claimed is:

1. An electrical connector for receiving a circuit board including:

an elongated housing having a lengthwise slot extending therein to receive a corresponding lower portion of the circuit board;

a plurality of grooves side by side positioned transversely to the slot;

a plurality of contacts received within the corresponding grooves to contact a plurality of corresponding conductive pads disposed on the lower portion of the board;

two posts respectively positioned adjacent two ends of the slot, each post having a peg at the top to engage a corresponding hole in the board; and the improvement comprising:

a pair of pivotal latches respectively positioned at two ends of the housing wherein each latch lies obliquely forward at an angle in an initial rotatable position for the convenience of the insertion of the board, and is rotated with the board until the board confronts the posts and the latch is fixedly secured to the housing in a final fixed position.

2. The electrical connector as described in claim 1, wherein the latch further comprises a holding device to define a space for holding the board therein when the board is received in the slot.

3. The electrical connector as described in claim 2, wherein the holding device includes a front plate and a rear plate to sandwich the board therein.

4. The electrical connector as described in claim 3, wherein the post has a recess to receive the rear plate of the latch when the latch is in the final fixed position.

5. The electrical connector as described in claim 1, wherein the latch further includes a retention section having a retention plate to engage the post when the latch is in the final fixed position.

6. The electrical connector as described in claim 5, wherein a camming plate extends from the retention plate to incorporate with a wedge of the post during rotation of the board.

7. The electrical connector as described in claim 1, wherein a pair of cavities are formed at two ends of the housing to receive the corresponding latch, respectively, a pair of protrusions positioned in each cavity to engage a pair of apertures of the latch for defining an axis around which the latch is rotatable.

8. The electrical connector as described in claim 7, wherein the latch has a U-shaped base, and a lever at the top for applying finger pressure.

9. A pivotal latch for a connector comprising:

a base to be mounted in a cavity in a housing for the connector, said base having a U-shaped configuration, a pair of apertures positioned therein to define an axis around which the latch rotates;

a holding device to maintain a board therein for rotation with a board; and a retention section to engage the housing of the connector for securement of the latch.

10. The latch as described in claim 9, wherein the holding device includes a front plate and a rear plate to define a space and sandwich the board therein.

11. The latch as described in claim 9, wherein the retention section includes a retention plate and a camming plate extending therefrom.

12. The latch as described in claim 9, wherein the latch includes a lever at the top.

13. An electrical connector for receiving a circuit board, said connector comprising:

an elongated housing having a lengthwise slot extending therein to receive an corresponding lower portion of the circuit board;

a plurality of contacts transversely positioned to the slot to contact a plurality of corresponding conductive pads disposed on the lower portion of the board;

at least a latch positioned on one end of the housing, said latch having a holding device to retain the board therein and rotated with the board until the latch is in a fixed position.

14. The electrical connector as described in claim 13, wherein the latch is rotated around an axis which is defined in a lengthwise direction of the housing.

15. The electrical connector as described in claim 13, wherein the latch includes a retention section to incorporate with a post for securement of the latch to the housing.

16. The electrical connector as described in claim 13, wherein the housing has at least a cavity at one end to receive the latch.

17. The electrical connector as described in claim 13, wherein the latch has a lever at the top.

18. The electrical connector as described in claim 13, wherein the latch is made of a one-piece metal plate.

* * * * *